US006203011B1

(12) United States Patent
Nulph

(10) Patent No.: US 6,203,011 B1
(45) Date of Patent: Mar. 20, 2001

(54) SYSTEM FOR ADMINISTERING AN INTERACTIVE TRANSACTION IN A LOTTERY GAME

(75) Inventor: James L. Nulph, Cumming, GA (US)

(73) Assignee: Scientific Games, Inc., Alpharetta, GA (US)

( * ) Notice: Subject to any disclaimer, the term of this patent is extended or adjusted under 35 U.S.C. 154(b) by 0 days.

(21) Appl. No.: 09/282,044

(22) Filed: Mar. 30, 1999

(51) Int. Cl.[7] ..... A63F 3/06

(52) U.S. Cl. ..... 273/138.2; 273/139; 463/17; 283/901; 283/903

(58) Field of Search ..... 273/138.2, 139; 463/17, 42; 283/901, 903

(56) References Cited

U.S. PATENT DOCUMENTS

| | | | | |
|---|---|---|---|---|
| 4,560,171 | | 12/1985 | Anthony | 273/269 |
| 4,756,532 | | 7/1988 | Kamille | 273/153 |
| 4,775,155 | | 10/1988 | Lees | 273/139 |
| 4,964,642 | | 10/1990 | Kamille | 273/240 |
| 5,092,598 | | 3/1992 | Kamille | 273/139 |
| 5,100,139 | | 3/1992 | Di Bella | 273/138 |
| 5,118,109 | | 6/1992 | Gumina | 273/139 |
| 5,158,293 | | 10/1992 | Mullins | 273/139 |
| 5,365,575 | * | 11/1994 | Katz | 379/92 |
| 5,407,199 | | 4/1995 | Gumina | 273/139 |
| 5,407,200 | | 4/1995 | Zalabak | 273/139 |
| 5,569,082 | * | 10/1996 | Kaye | 463/17 |
| 5,577,971 | | 11/1996 | File | 473/54 |
| 5,613,679 | | 3/1997 | Casa et al. | 273/138 |
| 5,628,684 | | 5/1997 | Bouedec | 463/17 |
| 5,657,991 | | 8/1997 | Camarato | 273/269 |
| 5,664,781 | | 9/1997 | Feola | 273/292 |
| 5,772,511 | * | 6/1998 | Smeltzer | 463/17 |
| 5,791,990 | * | 8/1998 | Schroeder et al. | 463/17 |

* cited by examiner

*Primary Examiner*—Benjamin H. Layno

(57) ABSTRACT

In a method of administering an interactive transaction in a lottery game, a plurality of play spots is printed on each lottery ticket of a plurality of lottery tickets. Each play spot has a value selected from a set of values and the values of the play spots are distributed randomly on the tickets. Thus, the distribution makes it impossible to predict the values of the play spots on a given ticket of the plurality of tickets based on knowledge of the values of play spots of other tickets of the plurality of tickets. Each of the plurality of play spots is covered with a removable medium and a unique identifier is placed on each ticket. A record of the unique identifier and of the values of the play spots for each ticket are stored in a database. If a first communication has been received from a distributor indicating that a user has properly obtained a distributed ticket, then the record of the unique identifier corresponding to the distributed ticket is flagged to indicate that the distributed ticket may be activated and if a second communication has been received from the user that identifies the distributed ticket, then interactive data is received from the user; the user is instructed to uncover a preselected set of play spots by removing the removable medium; and the record of the unique identifier corresponding to the distributed ticket is flagged to indicate that the distributed ticket has been activated.

23 Claims, 9 Drawing Sheets

SYSTEM FOR ADMINISTERING AN INTERACTIVE TRANSACTION IN A LOTTERY GAME

BACKGROUND OF THE INVENTION

1. Field of the Invention

The present invention relates to transactions and, more specifically, to interactive transactions such as games and tests.

2. Description of the Prior Art

Interactive transactions, as used herein, are transactions between a controlling authority and a user. A typical interactive transaction involves the user participating in a game, test, or the like, and transmitting information, regarding, e.g., play of a game or answers to questions on a test, to the controlling authority. The controlling authority then transmits information to the user related to the user's information that is used in the transaction. For example, the controlling authority could transmit to the user information necessary for the user to receive a prize or information as to the scoring of a test. Examples of interactive transactions include games played over a communications network (such as the Internet and telephone networks) and tests that are taken at one location and scored remotely via a communications network.

One type of interactive game is a player-activated lottery, in which a player purchases a lottery ticket and then interacts with the lottery controlling authority to activate the ticket. This type of game offers the advantage of allowing the player to purchase a ticket at one time and then activate the ticket at a later time. For example, the user could purchase a ticket at a time when the lines are relatively short and then wait until a lottery jackpot has accumulated a substantial prize to activate a ticket. To play the game, the user purchases a ticket and communicates with a controlling authority to activate the ticket. In the communication, the user indicates the date on which he wishes to play the ticket and the numbers that he wishes to play.

Existing systems for interactive lottery have several disadvantages, including the disadvantage of being unpopular with lottery ticket retailers. This is because the retailer is unnecessary to play the ticket so that the retailer may be bypassed in the lottery process. Also, most existing systems for interactive lottery require the user to purchase the ticket with a credit card. However, such purchases are illegal in most states.

Another type of interactive game is an interactive game of skill. Most existing interactive games have the disadvantage of lacking efficient mechanisms for administering the games. Furthermore, existing systems have the disadvantage of not having an effective method of distributing interactive games via retailers and the disadvantage of not being able to award prizes through local retailers.

SUMMARY OF THE INVENTION

The disadvantages of the prior art are overcome by the present invention which, in one aspect, is a method of administering an interactive transaction. A plurality of play spots is printed on each ticket of a plurality of tickets. Each play spot has a value selected from a set of values and the values of the play spots are distributed randomly on the tickets. Thus, the distribution makes it impossible to predict the values of the play spots on a given ticket of the plurality of tickets based on knowledge of the values of play spots of other tickets of the plurality of tickets. Each of the plurality of play spots is covered with a removable medium and a unique identifier is placed on each ticket. A record of the unique identifier and of the values of the play spots for each ticket are stored in a database. If a determination has been made indicating that a user has properly obtained a distributed ticket, then the record of the unique identifier corresponding to the distributed ticket is flagged to indicate that the distributed ticket may be activated. If a communication has been received from the user that identifies the distributed ticket, then interactive data is received from the user; the user is instructed to uncover a preselected set of play spots by removing the removable medium; and the record of the unique identifier corresponding to the distributed ticket is flagged to indicate that the distributed ticket has been activated.

In another aspect, the invention is a ticket for administering an interactive lottery game. The ticket includes a substrate and a first plurality of play spots printed on the substrate. Each play spot shows one of a plurality of lottery play values and is covered with a removable covering. Each removable covering includes a symbol that is not related to the lottery play value being covered and that uniquely identifies the play spot. The ticket also includes a second plurality of play spots printed on the substrate wherein each shows one component of a date so that each of a plurality of combinations of play spots of the second plurality of play spots identifies a different date. The second plurality of play spots includes sufficient play spots to identify each date included in a preselected range of dates. The ticket also includes a scanable identifier that uniquely identifies the ticket.

Yet another aspect of the invention is a ticket for administering an interactive game. The ticket includes a plurality of play spots printed on a substrate. Each play spot shows a result of a user's play of a game and is covered with a removable covering. Each removable covering includes a symbol that is not related to the result being covered and uniquely identifies the play spot. The ticket also includes a scanable identifier that uniquely identifies the ticket and an electronic address printed on the substrate that indicates a point of contact that a user would access to participate in an interactive game.

Yet another aspect of the invention is a method of authenticating a ticket. A plurality of verification spots is printed on each of a plurality of tickets. Each verification spot has a value and the values of the verification spots are randomly distributed on the plurality of tickets, thereby making it impossible to predict the values of verification spots on a given ticket based on knowledge of the verification spots on other tickets of the plurality of tickets. Each of the plurality of verification spots is covered with a removable medium and a unique identifier is placed on each ticket. A first record of the unique identifier on each ticket and a second record of each of a selected set of values of the verification spots on each ticket are stored in a database. The second record is associated with the first record for each ticket. A selected ticket is distributed to a user and the user is instructed to remove the removable medium covering a set of verification spots on the selected ticket corresponding to a verification code. The unique identifier on the selected ticket and the exposed verification code on the ticket are input into a computer as part of a verification process. The verification code is compared to the second record of the selected set of values of the verification spots associated with the first record of the unique identifier corresponding to the unique identifier on the selected ticket. If the comparing step indicates that the verification code is identical to the selected set of values, then the it is indicated that the selected ticket has been successfully authenticated, otherwise it is indicated that the selected ticket has not been successfully authenticated.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
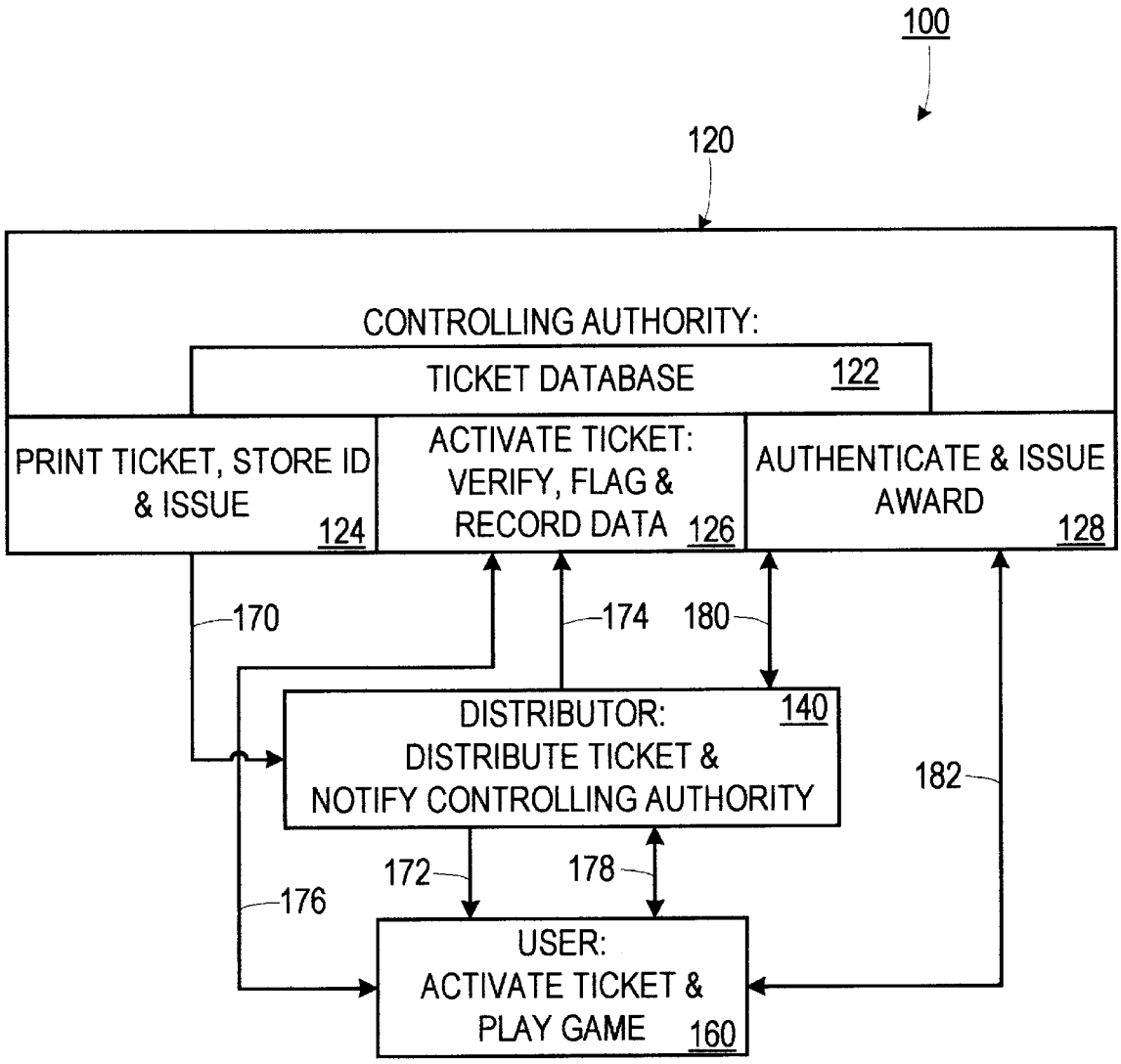
FIG. 1 is a schematic diagram showing the interrelationship between the various entities that use one embodiment of the invention.

A preferred embodiment of the invention is now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, as used herein, lottery means an event involving chance in which a prize is awarded and the ability to play is based on receipt of consideration. Sweepstakes means an event involving chance in which a prize is awarded, but in which there in no receipt of consideration in exchange for being allowed to play.

As shown in FIG. 1, the present invention employs a system 100 of several different interrelated entities. A controlling authority 120 (e.g., a lottery ticket issuing organization) generates and administers a plurality of tickets used in games or as score cards. The controlling authority 120 maintains a database 122 containing a record of each ticket. When the controlling authority 120 prints a ticket 124, it stores an unique identification of the ticket in the database 122. The controlling authority 120 issues 170 the ticket to a distributor 140 (e.g., a convenience store that sells lottery tickets), who then distributes 172 the ticket to a user 160. It should be noted that, although in this figure the controlling authority 120 is shown as a single entity, it could actually comprise several different entities, with each performing a separate function.

As part of the distribution process, the distributor 140 communicates 174 with the controlling authority 120 to indicate that the ticket has been properly distributed to a user 160. This communication 174 may be done using a scanning device, such as a bar code reader, a mag stripe reader or other devices that are capable of reading an identifier on a ticket and communicating with the controlling authority 120. (It should be noted that while the present invention will work especially well with electronic devices, such as bar code scanners, other forms of communication, such as voice communication over the telephone, are possible, without departing from the scope of the invention.) The controlling authority 120 then flags 126 the record in the database 122 corresponding to the ticket, thereby indicating that the ticket may be played.

In an alternate embodiment, the controlling authority 120 may directly indicate that a ticket, or group of tickets, has been properly distributed to a user 160 (or group of users). In this scenario, tickets could be directly distributed to the user 160 and the controlling authority 120 would directly update the database 122 to reflect that the tickets are authorized to be played by the user 160. Such pre-authorized tickets could also be transferred to the distributor 140, who then distributes them to the user 160. One illustrative example of direct distributing would occur when tickets are distributed as part of a promotional activity.

The user 160 communicates 176 with the controlling authority 120 to use the ticket. This communication could be conducted over a telephone line, using voice prompts, via the Internet or over any other communication system in which two parties can communicate (e.g., cellular networks, broadband, direct satellite, etc.). The user 160 first communicates the unique identification of the ticket and then sends data relative to play of the game. The controlling authority flags 126 the record in the database 122 corresponding to the ticket to indicate that the ticket has been played and may not be played again. The controlling authority 120 also transmits data to the user 160 including instructions as to how to modify the ticket so that it will reflect the data relative to play sent by the user 160. As part of this process, the controlling authority 120 will modify the record corresponding to the ticket in the database 122 to record 126 any play data exchanged between the user 160 and the controlling authority 120. Such play data could include, for example, such things as lottery play numbers chosen by the user 160, moves made during an interactive game or answers to a test. Typically, the controlling authority 120 will associate a record of the data sent by the user 160 with a record of the ticket in the database 122.

The user 160 will then have the played ticket authenticated 128 by the controlling authority 120. This could be accomplished by directly contacting 182 the controlling authority 120 if the controlling authority 120 had remote terminals for ticket authentication. It could also be done by taking the ticket 178 to the distributor 140 for authentication. In this case, the distributor 140 contacts 180 the controlling authority 120, identifies the ticket and indicates how the ticket has been modified by the user 160. If the modifications correspond to the record of the ticket in the database 122, then the controlling authority will indicate that the ticket has been authenticated. If the modification to the ticket indicates that the user 160 is eligible for a prize, then the distributor 140 will issue the prize to the user 160 and the controlling authority will reimburse 180 the distributor 140 for the value of the prize. If the system employs the direct method of authentication 182, then the controlling authority 120 will issue the prize directly 128.

Figure 2:
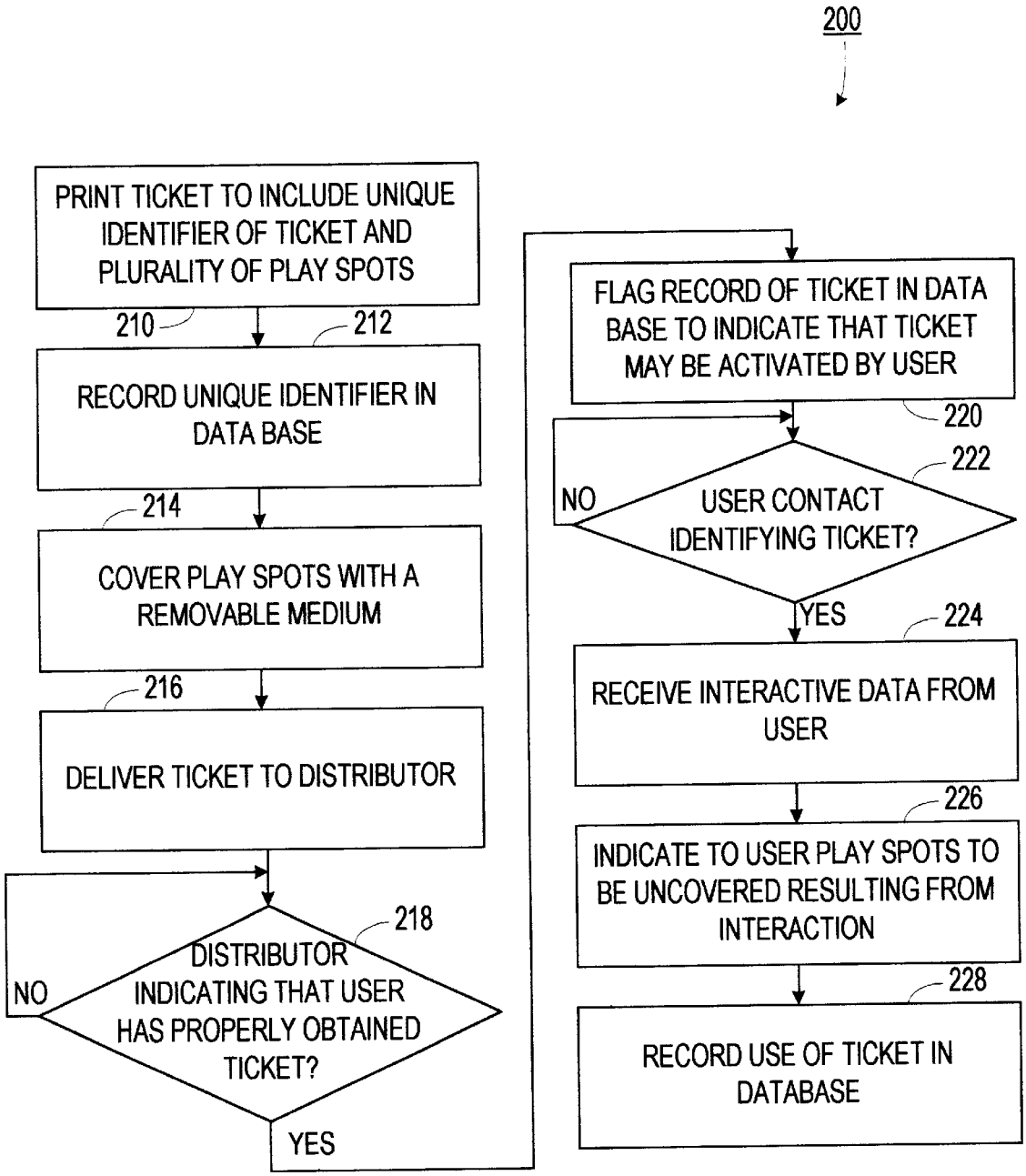
FIG. 2 is a flowchart showing the steps performed by the issuing entity in using one embodiment of the invention.

As shown in FIG. 2, the flow of operations 200 from the controlling authority's perspective begins with the printing of a ticket 210. Printed on the ticket is a plurality of play spots, with each play spot including some sort of symbol, such as a number. Also placed on the ticket is a unique identifier. A record of the unique identifier is recorded 212 in a database and the play spots are covered 214 with a removable medium. Examples of the removable media include: scratchable latex coverings, pull tabs and peel-off labels. Then the ticket is delivered 216 to the distributor.

The controlling authority waits until the distributor has indicated 218 that the ticket has been properly obtained by a user. Once this has happened, the controlling authority updates the database by flagging 220 the record corresponding to the ticket to indicate that the ticket may be activated by the user.

The controlling authority then waits until it has been contacted by the user 222. When the user contacts the controlling authority, the controlling authority first receives the unique identifier from the user. This could be in response to a voice prompt via telephone or a text prompt via a computer network. It is conceivable that the user's computer could be equipped with a device, such as a bar code scanner or mag stripe reader, that reads the unique identifier directly from the ticket and transmits the information contained therein directly to the controlling authority.

Once the ticket has been properly identified, the controlling authority accesses the record of the ticket in the database to verify that the ticket has been flagged as having been properly obtained by the user from the distributor. If so, the controlling authority receives 224 interactive data from the user. This data could take the form of an indication of which lottery numbers that the user desires to play and the desired play date of the ticket. It could also take the form of indications of desired moves in an interactive game, such as an on-line board game, where the user interacts with other players or a virtual computer-based opponent in a game of skill.

Once the controlling authority has received all of the interactive data, the controlling authority indicates 226 to the user the play spots that are to be uncovered resulting from the receipt of the interactive data. For example, in the case of a lottery, the controlling authority would indicate to the user the play spots corresponding to the chosen lottery play numbers and the date that the ticket is to be played. In the interactive game example, the controlling authority would instruct the user to uncover the play spots that would indicate such things as the user's score or the prize won by the user.

Once the ticket has been played by the user, the controlling authority records 228 in the database an indication that the ticket may no longer be played.

Figure 3:
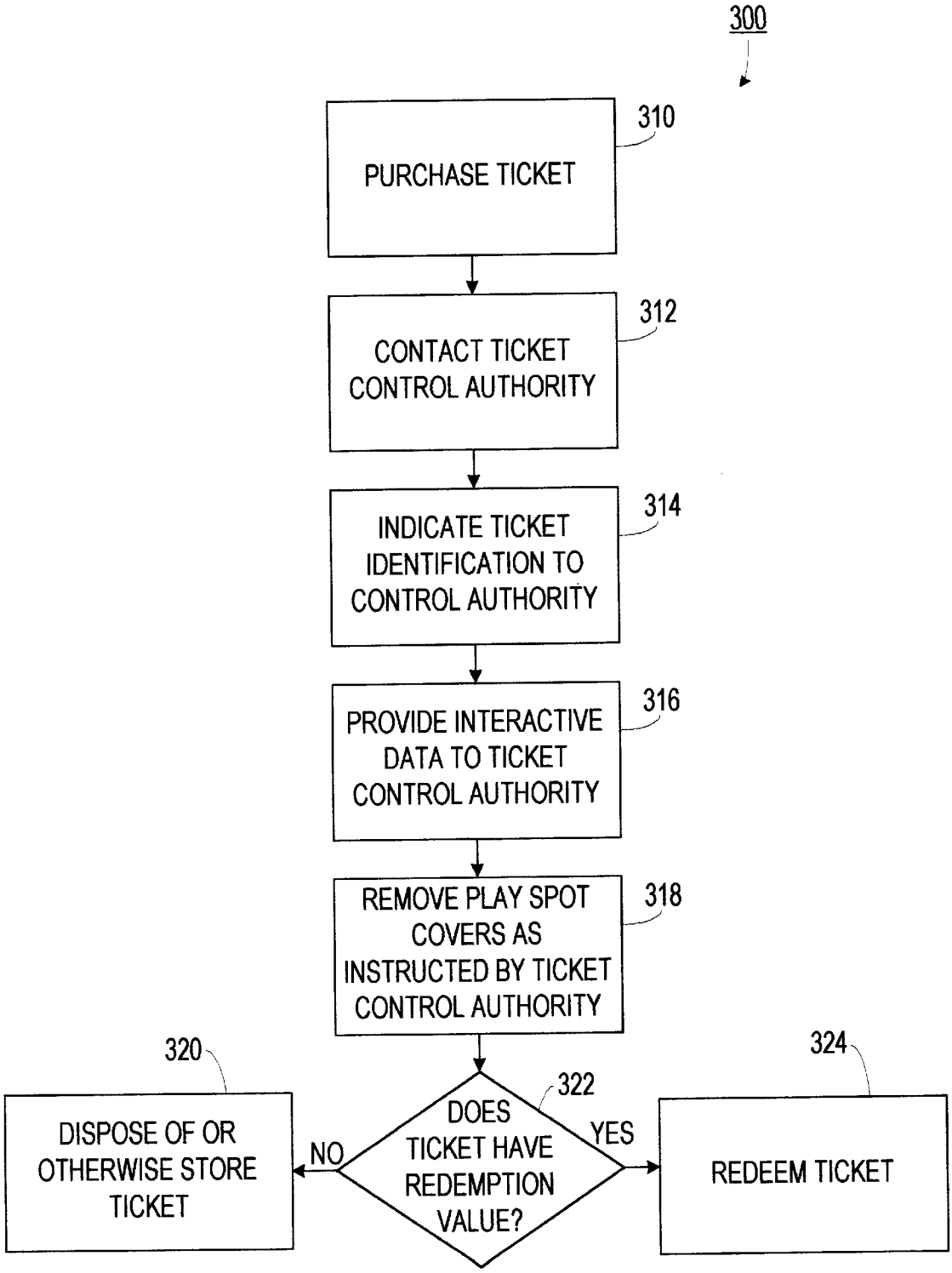
FIG. 3 is a flowchart showing the steps performed by a user of one embodiment of the invention.

As shown in FIG. 3, the flow of operations 300 from the user's perspective begins with the user purchasing 310, or otherwise properly obtaining, a ticket. In an alternate example of properly obtaining a ticket, the user could receive the ticket and then go to a distributor and have it activated for a preselected fee. In another example, the ticket could be issued to the user for free as part of a promotional activity.

Once the user has properly obtained the ticket, the controlling authority is contacted 312 and an indication of the unique identifier is transmitted 314 to the controlling authority. This may be done verbally, if the controlling authority employs an operator or uses a voice response unit, or electronically. An example of an electronic embodiment uses the key-pad of a telephone or a computer-based data transmission.

The user then provides 316 the interactive data to the control authority. Then the user removes the play spot coverings 318 in accordance with the instructions of the control authority. If the ticket has a redemption value 322, for example if the user wins a prize, then the user redeems the ticket 324, otherwise the user disposes of or stores 320 the ticket.

Figure 4:
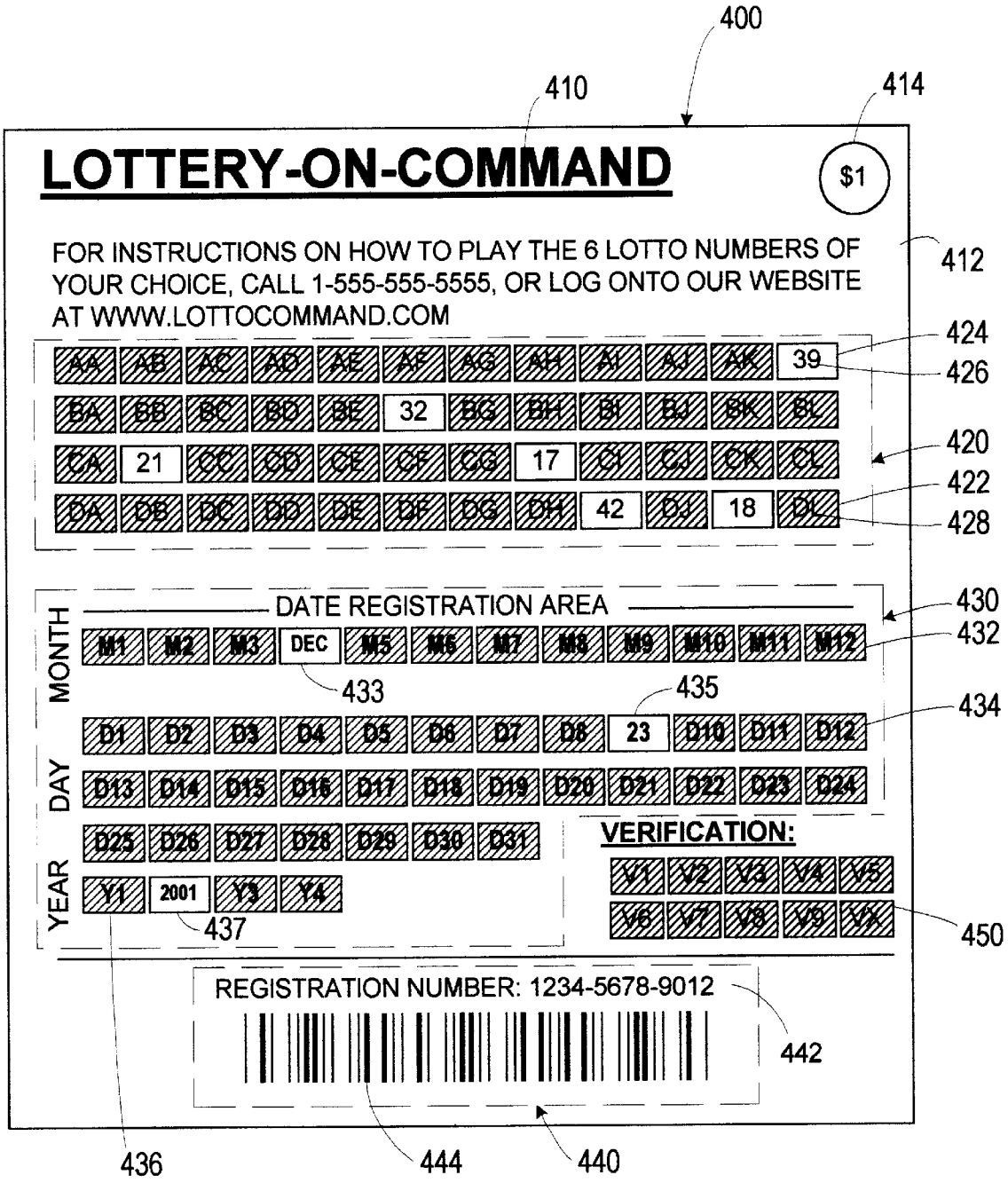
FIG. 4 is a front view of a lottery ticket that is usable in accordance with a first embodiment of the invention.

As shown in FIG. 4, a ticket 400 for a "lottery on command" game would have printed thereon the title 410 of the game, instructions 412 on to how to play the game, a plurality of game number play spots 420, a plurality of activation date play spots 430, and a unique identifier 440. A plurality of verification play spots 450 and an indication 414 of the cost of the ticket may also be included.

Initially, all play spots are covered. The removable covering of a covered play spot 422 of the plurality of game number play spots 420 has printed thereon a symbol 428 that identifies the play spot, but that may not correspond directly to the value of the play spot. An uncovered play spot 424 would show the lottery number 426 that the user desires to play using the ticket 400. To improve security, the numbers 426 of the plurality of play spots 420 may be randomly distributed from ticket to ticket so that the user cannot tell where the play spots are on any given ticket based on the user's knowledge of the location of play spots on other tickets.

The activation date play spots 430 would include month identifying play spots 432, day identifying play spots 434, and, possibly, year identifying play spots 436. The date play spots may also be randomly distributed from ticket to ticket and covered with arbitrary symbols, to reduce claims by the user that the ticket was played on a different date than that originally chosen by the user. In the example shown, the uncovered month play spot 433 shows "December" and was covered with the symbol "M4," the uncovered day play spot 435 shows "23" and was covered with the symbol "D9" and the uncovered year play spot 437 shows "2001" and was covered with the symbol "Y2." Thus, if the user desired to play the ticket 400 on "Dec. 23, 2001," then the controlling authority would instruct him to remove the covering of play spots "M4," "D9" and "Y2."

The unique identifier 440 would include a readable identification number 442 and may also include a machine readable code, such as a bar code 444 or a magnetic stripe (not shown). Depending on the embodiment, one or both of these types of uniquely identifying the ticket 400 would be employed.

Figure 5:
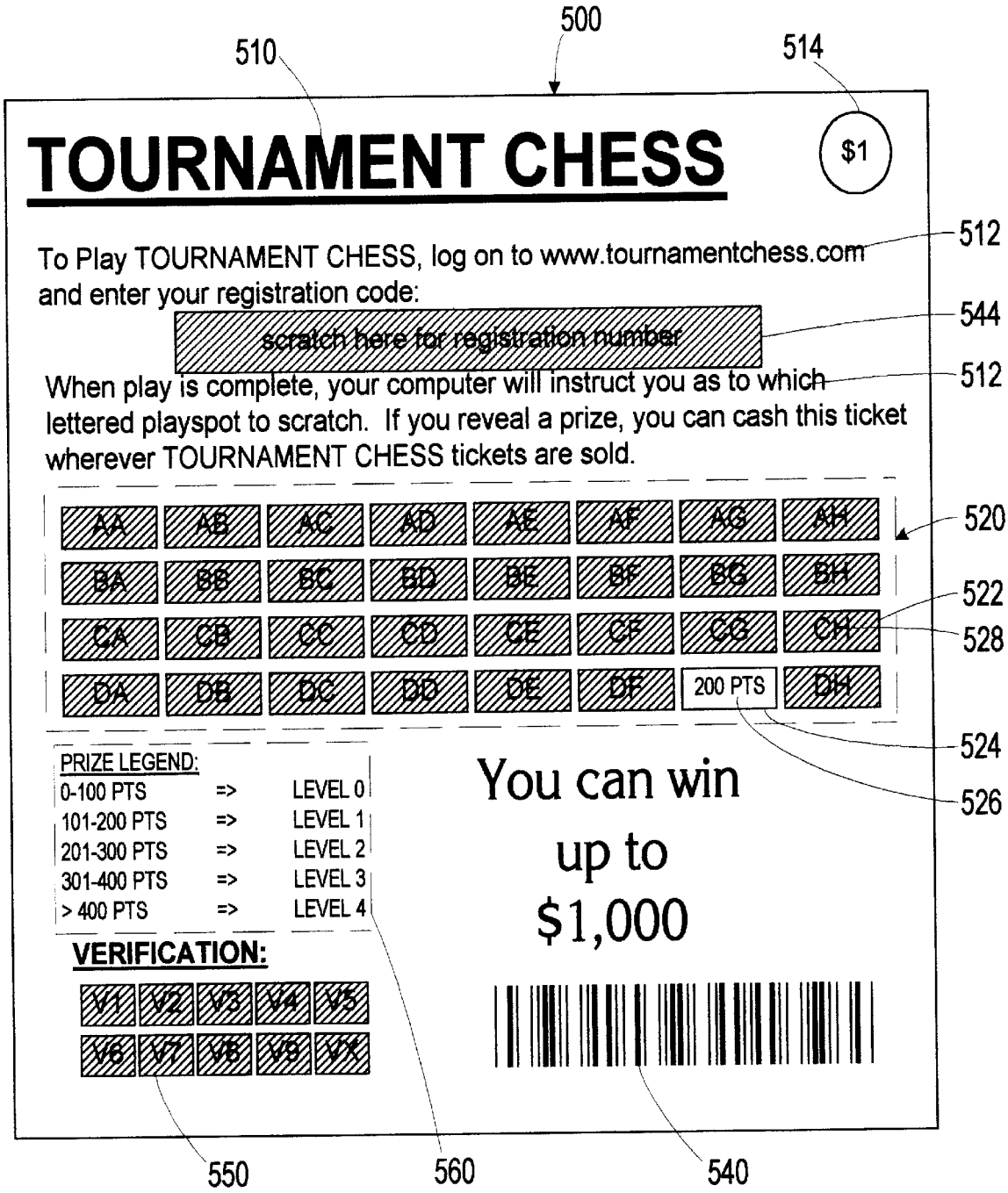
FIG. 5 is a front view of an interactive game ticket that is usable in accordance with a second embodiment of the invention.

As shown in FIG. 5, a ticket 500 for an interactive game of skill would have printed thereon the title 510 of the game, instructions 512 on to how to play the game, a plurality of play spots 520, and a unique identifier 540. As shown in this embodiment, the unique identifier could include a covered registration number 544 for added security. A plurality of verification play spots 550 and an indication 514 of the cost of the ticket may also be included.

Initially, all play spots are covered. The removable covering of a covered play spot 522 has printed thereon a symbol 528 that identifies the play spot, but that may not correspond directly to the value of the play spot. An uncovered play spot 524 would show the value 526 that would correspond to the results of the user's play of the interactive game. In one example, the value 526 would show a point score awarded to the user, with such a point score corresponding to a prize level shown in a prize legend 560 printed on the ticket. In the example shown, if the user's play resulted in an award of 200 points, then the user would be eligible for a prize corresponding to prize level 1. This could be one predetermined prize (e.g., a cash prize) or the system could allow the user to select from a group of prizes having similar values (e.g., a cash prize, a consumer product, or a service, etc.). Alternately, the value 526 could directly recite a prize won by the user. As in the lottery embodiment, the values 526 of the plurality of play spots 520 may be randomly distributed from ticket to ticket so that the user cannot tell where the play spots are on any given ticket based on the user's knowledge where the play spots are on other tickets.

Figure 6:
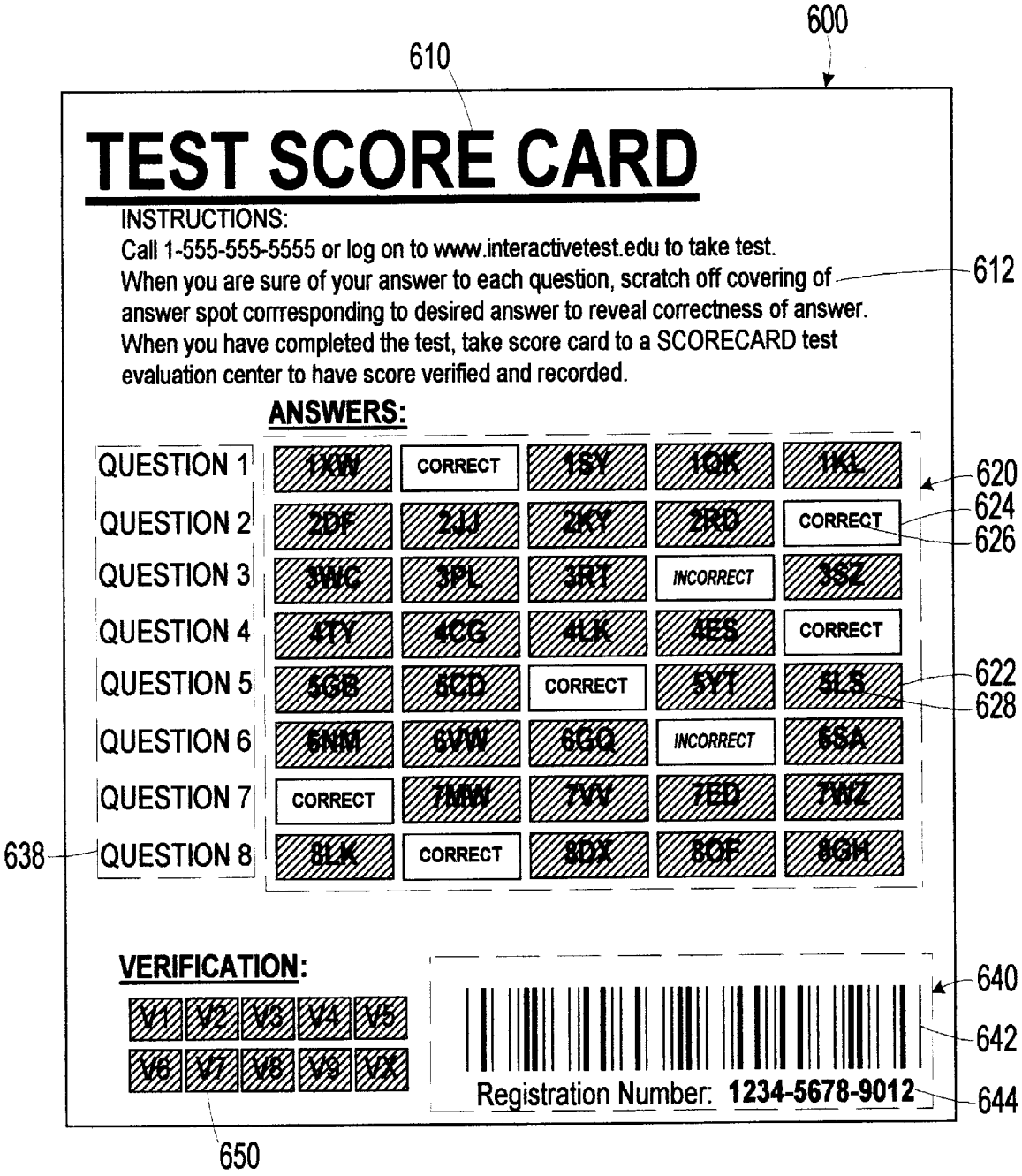
FIG. 6 is a front view of a test score card-type ticket that is usable in accordance with a third embodiment of the invention.

As shown in FIG. 6, a ticket 600 to be used as a test scorecard would have printed thereon the title 610 of the scoring system, instructions 612 on to how to take a test using the scorecard 600, a plurality of answer play spots 620, and a unique identifier 640, which could include a bar code 642 and a readable registration number 644. A plurality of verification play spots 650 may also be included.

Each row of answer play spots 620 is preceded by a printed identifier of the question number 638 that corresponds to the question that the row contains an answer thereto. The removable covering of a covered answer play spot 622 has printed thereon a symbol 628 that identifies the answer play spot, but that does not correspond directly to the value of the play spot so that the user does not know what covered play spot corresponds to a given answer until instructed to uncover the play spot by the control authority. An uncovered play spot 624 would show the value 626 of the answer submitted by the test taker in answer to a question. (For example, it could give an immediate indication of whether the answer is correct or incorrect.) The numbers 626 of the plurality of play spots 620 are randomly distributed from ticket to ticket so that the user cannot tell where the play spots are on any given ticket based on the user's knowledge where the play spots are on other tickets.

Although the examples of tickets disclosed in FIGS. 4–6 show the values of play spots being designated by numbers, it will be readily appreciated that the values of play spots could be designated using other symbols without departing from the scope of the invention. For example, such values could be designated using letters, decorative symbols (e.g., stars, hearts, diamonds, etc.), words or combinations thereof.

Figure 7:
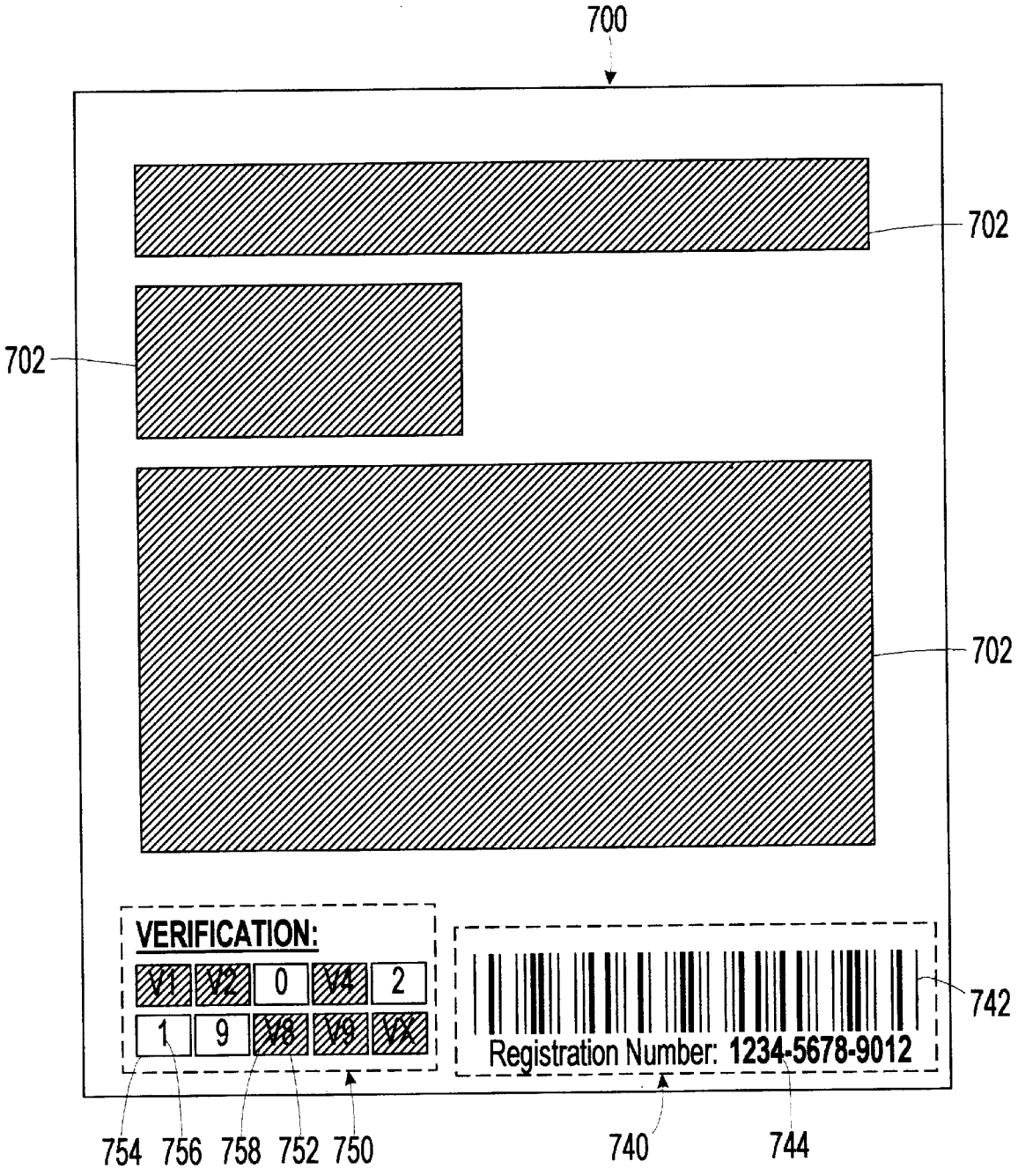
FIG. 7 is a front view of a ticket that shows a verification code.

The verification system embodiment is shown in FIG. 7. In this embodiment, a ticket 700 is printed with information 702, which could include text or play spots, and a unique identifier 740, which could include a bar code 742 and a readable registration number 744.

A plurality of verification play spots 750 are also included. The verification play spots are initially covered 752 with a removable covering that has a symbol 758 printed thereon. Once the user completes an operation, the controlling authority instructs him to remove the covering of a preselected set of the play spots 750. The uncovered play spots 754 would then show a code 756 (the code 756 being the combination of values of all of the uncovered play spots 754) that could be entered into a computer system and that would correspond to the unique identifier 740, either directly (e.g., showing the last four digits of the registration number 744) or associatively in the database. This would allow quick and secure verification of the authenticity of the ticket 700 by the controlling authority.

The computer could determine if the authenticity of the code 756 in several ways. For example, the computer could store a predetermined authentication code for each ticket in the database. Thus, verification is a simple matter of finding the record corresponding to the unique identifier 740, retrieving the predetermined code and comparing it to the code 756. This embodiment provides a high level of security, but has the overhead relating to the controlling authority being accessed every time that the ticket 700 is authenticated.

In another example of authentication, the code 756 is a preselected set of digits of the registration number and one merely compares these digits to the code 756 to verify the ticket 700. This method would allow verification of the ticket by sight and, thus, would involve lower overhead for tickets that are repeatedly authenticated. However, this method might be more vulnerable to forgery and, therefore, would be recommended when the likelihood or consequences of forgery are relatively low.

In yet another example, the code 756 is algorithmicly determined by a computer. Such a method would employ an algorithm that would calculate the value of the code 756 based on such values as: the registration number, the date of play, etc. Many different algorithms known to computer science could be employed (e.g., hashing, enciphering, arithmetic, etc.). This method would allow a high level of security and remote verification without the necessity of connecting to the controlling authority every time a verification is to be made. This method would be recommended when authenticating tickets using a remote terminal that is not usually connected to the controlling authority at the time of authentication.

While the verification embodiment of the invention would improve the security of interactive games, it could also be used to verify tickets used in many other applications. In one example that is unrelated to interactive games, the ticket 700 could be attached to aircraft parts and the verification system could be used to verify that a given part has properly passed an inspection. In another example, the ticket 700 could be used to control access to a limited access event, such as a college admissions test.

Figure 8:
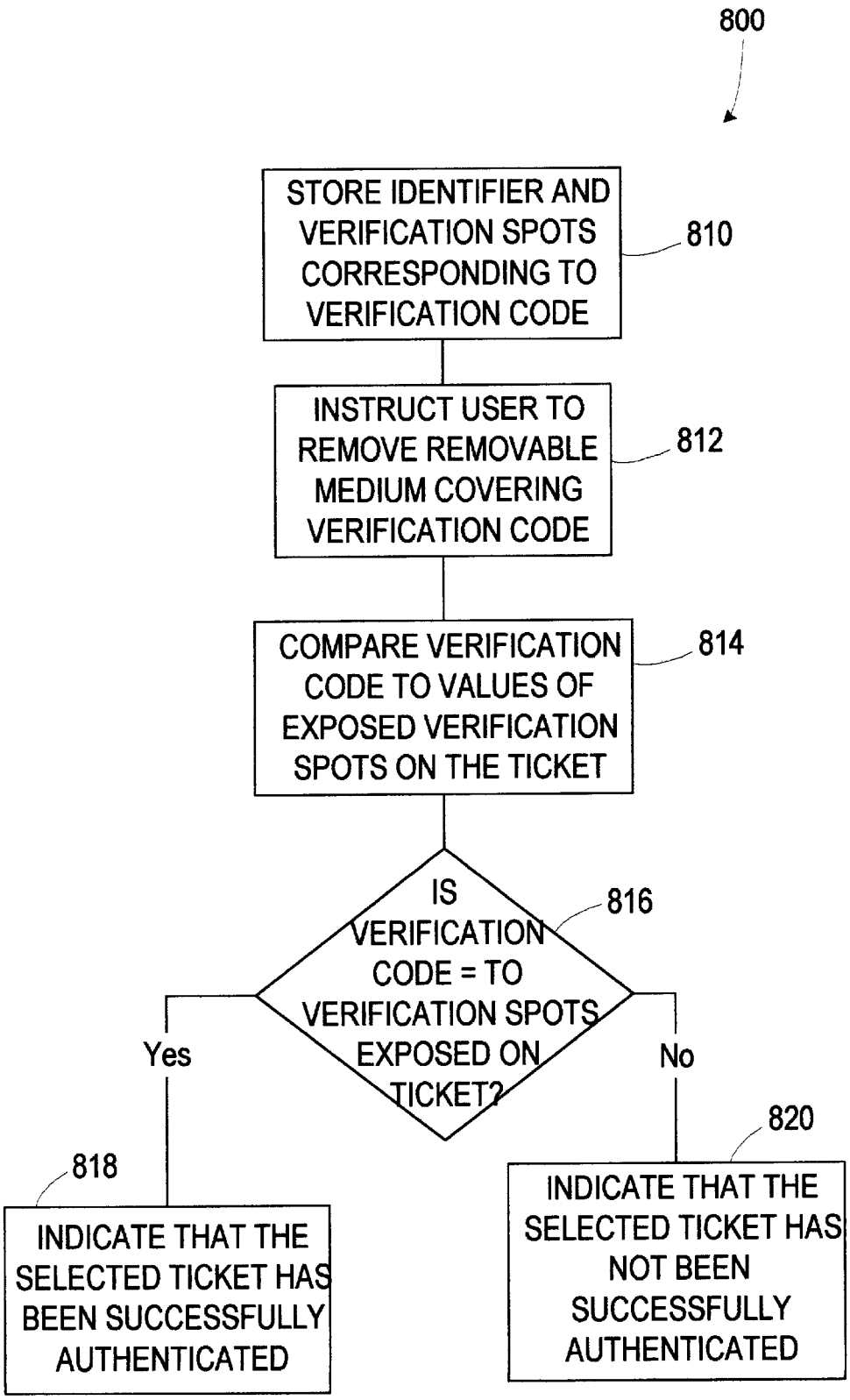
FIG. 8 is a flow chart showing the steps performed in verifying a ticket.

FIG. 8 shows one embodiment of the system 800 employed in the verification process. When the ticket is printed, a record of the unique identifier printed thereon is stored 810 in a database, along with an associated record of a verification code. At the time that the ticket is to be activated, the user is instructed 812 to remove a preselected set of play spots corresponding to the verification code. When it is necessary to verify the authenticity of the ticket, the controlling authority is contacted with information concerning both the unique identifier and the exposed verification code play spots. The system compares 814 the exposed verification play spots to the verification code associated with the unique identifier of the ticket and determines 816 whether the verification code corresponds to the exposed play spots. If they correspond, the system indicates 818 that the ticket has been successfully authenticated. Otherwise, the system indicates 820 that the ticket has not been successfully authenticated.

Figure 9:
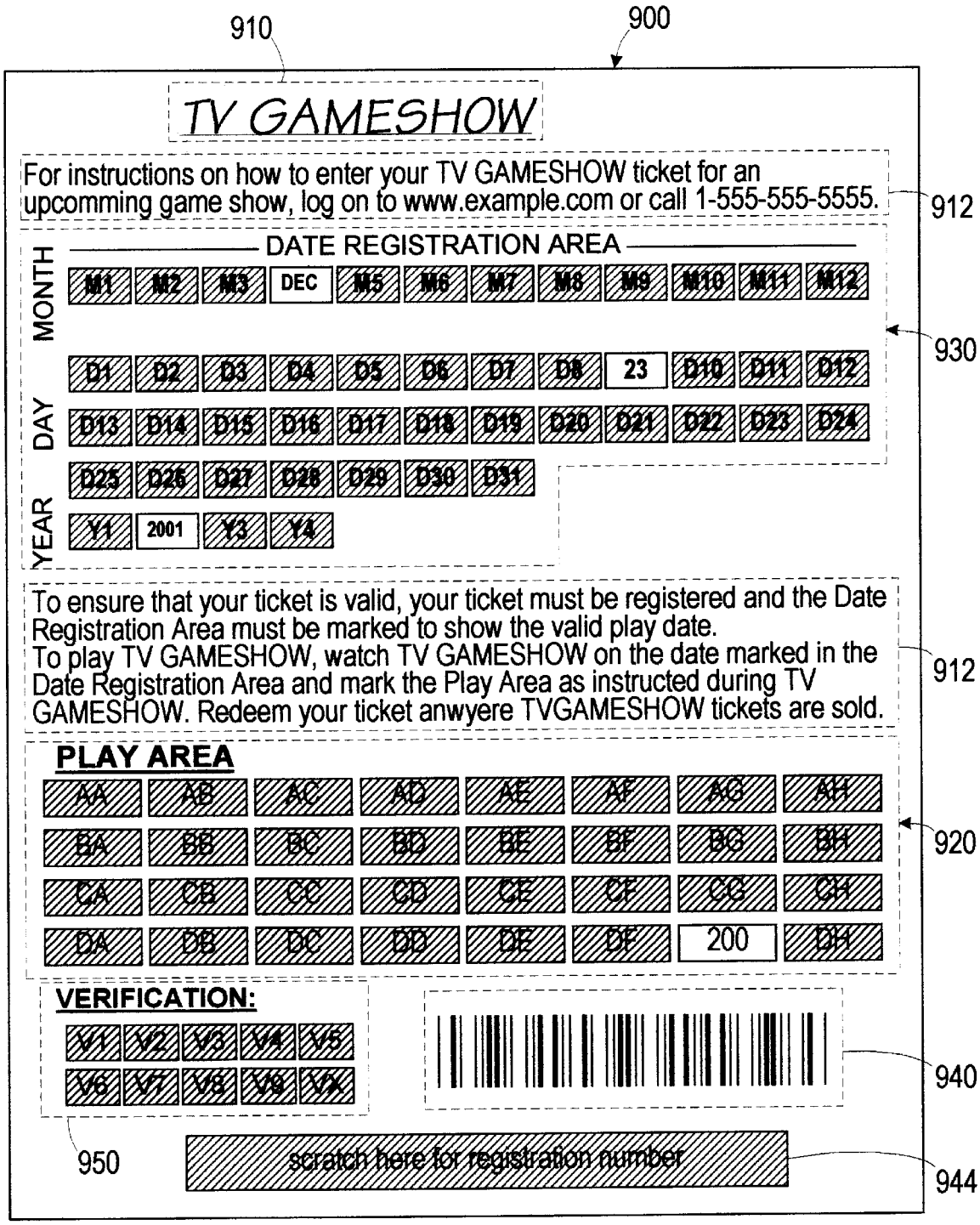
FIG. 9 is a front view of an interactive game ticket that embodies a game show format.

As shown in FIG. 9, an embodiment configured to play an interactive television game show, or interactive televised program, includes a ticket 900 having a game identifier 910 and game instructions 912 printed thereon. A plurality of play spots 920 and a plurality of date registration spots 930 are also printed on the ticket. Also included on the ticket 900 is a plurality of verification spots 950, a scanable identifier (such as a bar code 940) and a registration number 944. To play this embodiment, the user uncovers the registration number 944, logs onto the controlling authority's web site and indicates the desired date to play the game. The controlling authority then instructs the user to uncover the group of date registration spots 930 corresponding to the desired date of play and one or more of the verification spots 950. Once the ticket has been registered, the user watches the televised game show on the date indicated on the ticket. The controlling authority instructs the user via the televised game show to uncover one or more of the play spots 920, such instructions might relate directly to the results of play of the televised game show. Values of the uncovered play spots determine any prize that may be awarded to the user. This embodiment could be employed in a game of chance, or it could also be used in an interactive game of skill.

Another embodiment of the invention is a prepaid game card. In this embodiment, a user purchases a ticket for a selected amount of money, the controlling authority would record the amount paid for the ticket in and associate it with the unique identifier of the ticket. Then, the user could choose to play all or part of the value of the ticket at the time of the user's choosing. In one example of a lottery embodiment, the user could buy the ticket for $5.00 and at a later date decide to play three $1.00 lottery tickets. The user would contact the controlling authority and indicate that he wished to play three tickets. The controlling authority would then activate three plays for the user and deduct three dollars from the value of the ticket. At a later time, the user could purchase two more $1.00 plays and the controlling authority would execute the same process, but would then deactivate the ticket. It should be noted that this embodiment of the invention does not require a physical ticket. It could be embodied, for example, as an on-line virtual ticket. The only thing necessary is that the user know the unique identifier of the ticket.

The above described embodiments are given as illustrative examples only. It will be readily appreciated that many deviations may be made from the specific embodiments disclosed in this specification without departing from the invention. Accordingly, the scope of the invention is to be determined by the claims below rather than being limited to the specifically described embodiments above.

What is claimed is:

1. A method of administering an interactive transaction, comprising the steps of:

a. printing a plurality of play spots on each ticket of a plurality of tickets, each play spot having a value selected from a set of values, the values of the play spots being distributed randomly on the plurality of tickets, thereby making it impossible to predict the values of the play spots on a given ticket of the plurality of tickets based on knowledge of the values of play spots of other tickets of the plurality of tickets;

b. covering each of the plurality of play spots with a removable medium;

c. placing a unique identifier on each ticket;

d. storing a record of the unique identifier and of the values of the play spots for each ticket in a database;

e. if a determination indicating that a user has properly obtained a distributed ticket has been made, then performing the following steps:

i. flagging the record of the unique identifier corresponding to the distributed ticket to indicate that the distributed ticket may be activated; and ii. if a communication has been received from the user that identifies the distributed ticket, then performing the following steps: receiving interactive data from the user; instructing the user to uncover a preselected set of play spots by removing the removable medium covering the preselected set of play spots; and flagging the record of the unique identifier corresponding to the distributed ticket to indicate that the distributed ticket has been activated.

2. The method of claim 1, further comprising the step of modifying the record of the unique identifier corresponding to the distributed ticket to record the interactive data received from the user.

3. The method of claim 1, further comprising the steps of:

a. printing on each of the tickets a plurality of verification spots, each verification spot having a value, the values of the verification spots being randomly distributed on the plurality of tickets thereby making it impossible to predict the values of verification spots on a given ticket based on knowledge of the verification spots on other tickets of the plurality of tickets;

b. covering each of the plurality of verification spots with a removable medium;

c. storing in a database a first record of the unique identifier on each ticket and a second record of each of a selected set of values of the verification spots on each ticket and associating the second record with the first record for each ticket;

d. instructing the user to remove the removable medium covering a set of verification spots on the selected ticket corresponding to a verification code;

e. as part of a verification process, inputting into a computer the unique identifier on the selected ticket and the verification code on the ticket exposed as a result of the instructing step;

f. comparing the verification code to the first record of the selected set of values of the verification spots associated with the first record of the unique identifier corresponding to the unique identifier on the selected ticket; and g. if the comparing step indicates that the verification code is identical to the selected set of values, then indicating that the selected ticket has been successfully authenticated, otherwise indicating that the selected ticket has not been successfully authenticated.

4. The method of claim 1, further comprising the step of delivering a preselected number of tickets to a distributor.

5. The method of claim 4, wherein the step of printing a unique identifier occurs prior to the step of delivering the tickets to a distributor.

6. The method of claim 4, wherein the step of printing a unique identifier is performed by the distributor.

7. The method of claim 1, wherein the tickets are issued as part of a lottery.

8. The method of claim 7, wherein the receiving interactive data from the user step comprises the following steps:

a. receiving from the user a desired activation date, indicating a date on which the user desires to play the lottery; and b. receiving from the user a plurality of desired lottery play numbers, indicating numbers that the user has chosen for a ticket.

9. The method of claim 8, wherein the step of indicating to the user a preselected set of play spots that the user is to uncover comprises indicating to the user play spots corresponding to the plurality of desired lottery play numbers received from the user.

10. The method of claim 1, wherein the tickets are issued as part of a sweepstakes.

11. The method of claim 1, wherein the tickets are issued as scorecards in an interactive game of skill.

12. The method of claim 11, wherein the receiving interactive data from the user step comprises receiving data that indicates a desired action to be taken as part of playing a game of skill.

13. The method of claim 11, wherein the step of indicating to the user a preselected set of play spots that the user is to uncover by removing the removable medium comprises indicating to the user play spots that indicate results of a game of skill.

14. The method of claim 1, wherein the tickets are issued as scorecards in conjunction with an interactive test.

15. The method of claim 14, wherein the receiving interactive data from the user step comprises receiving data corresponding to answers to questions on a test.

16. The method of claim 1, wherein the receiving interactive data from the user step comprises receiving data via a computer network.

17. The method of claim 1, wherein the receiving interactive data from the user step comprises receiving data via a telephone network.

18. A ticket for administering an interactive lottery game, comprising:

a. a substrate;

b. a first plurality of play spots printed on the substrate, each play spot showing one of a plurality of lottery play values, each play spot covered with a removable covering, each removable covering including a symbol that is not related to the lottery play value being covered and that uniquely identifies the play spot;

c. a second plurality of play spots printed on the substrate, each play spot of the second plurality showing one component of a date so that each of a plurality of combinations of play spots of the second plurality of play spots identify a different date, the second plurality of play spots including sufficient play spots to identify each date included in a preselected range of dates; and d. a scanable identifier that uniquely identifies the ticket.

19. The ticket of claim 18, wherein each of the second plurality of play spots is covered with a removable covering.

20. The ticket of claim 18, further comprising an electronic address printed on the substrate that indicates a point of contact that a user would access to activate the ticket.

21. The ticket of claim 20, wherein the electronic address comprises a telephone number.

22. The ticket of claim 20, wherein the electronic address comprises a computer network address.

23. A method of authenticating a ticket, comprising the steps of:

a. printing on each of a plurality of tickets a plurality of verification spots, each verification spot having a value, the values of the verification spots being randomly distributed on the plurality of tickets thereby making it impossible to predict the values of verification spots on a given ticket based on knowledge of the verification spots on other tickets of the plurality of tickets;

b. covering each of the plurality of verification spots with a removable medium;

c. placing a unique identifier on each ticket;

d. storing in a database a record of the unique identifier on each ticket;

e. distributing a selected ticket to a user;

f. instructing the user to remove the removable medium covering a set of verification spots on the selected ticket corresponding to a verification code associated with the unique identifier on a ticket;

g. as part of a verification process, inputting the unique identifier and the exposed verification spots on the selected ticket;

h. comparing the exposed verification spots to a verification code associated with the unique identifier corresponding to the selected ticket; and i. if the comparing step indicates that the exposed verification spots are identical to the verification code, then indicating that the selected ticket has been successfully authenticated, otherwise indicating that the selected ticket has not been successfully authenticated.

* * * * *